US006675588B2

(12) United States Patent
Rudick

(10) Patent No.: US 6,675,588 B2
(45) Date of Patent: Jan. 13, 2004

(54) APPARATUS USING STIRLING COOLER SYSTEM AND METHODS OF USE

(75) Inventor: Arthur G. Rudick, Atlanta, GA (US)

(73) Assignee: The Coca-Cola Company, Atlanta, GA (US)

( * ) Notice: Subject to any disclaimer, the term of this patent is extended or adjusted under 35 U.S.C. 154(b) by 128 days.

(21) Appl. No.: 09/813,627

(22) Filed: Mar. 21, 2001

(65) Prior Publication Data

US 2001/0011459 A1 Aug. 9, 2001

Related U.S. Application Data

(63) Continuation-in-part of application No. 09/412,687, filed on Oct. 5, 1999.

(51) Int. Cl.[7] ..... F25B 9/00
(52) U.S. Cl. ..... 62/6
(58) Field of Search ..... 62/6, 296

(56) References Cited

U.S. PATENT DOCUMENTS

| | | | | |
|---|---|---|---|---|
| 1,815,170 | A | 7/1931 | Summers | |
| 2,095,008 | A | 10/1937 | Philipp | 62/115 |
| 2,342,299 | A | 2/1944 | Peet | 225/40 |
| 2,470,547 | A | 5/1949 | Childers | 62/103 |
| 2,512,545 | A | 6/1950 | Hazard | 62/125 |
| 2,660,037 | A | 11/1953 | Cooper | 62/116 |
| 2,672,029 | A | 3/1954 | Saunders | 62/117.2 |
| 2,885,142 | A | 5/1959 | Eberhart | 230/117 |
| 2,961,082 | A | 11/1960 | Hanson et al. | 194/13 |
| 3,004,408 | A | 10/1961 | Dros et al. | 62/419 |
| 3,206,943 | A | 9/1965 | Rice et al. | |
| 3,230,733 | A | 1/1966 | Rutishauser et al. | 62/256 |
| 3,302,429 | A | 2/1967 | Byrd | 62/514 |
| 3,712,078 | A | 1/1973 | Maynard et al. | 62/448 |
| 3,853,437 | A | 12/1974 | Horn et al. | 418/61 |
| 3,997,028 | A | 12/1976 | Lopez | 186/1 |
| 4,037,081 | A | 7/1977 | Aldridge et al. | 219/387 |
| 4,037,650 | A | 7/1977 | Randall | 165/29 |
| 4,138,855 | A | 2/1979 | Jahan et al. | 62/112 |
| 4,176,526 | A | 12/1979 | Missimer | 62/278 |
| 4,176,529 | A | 12/1979 | Stierlin et al. | 62/490 |
| 4,259,844 | A | 4/1981 | Sarcia et al. | 62/6 |
| 4,275,705 | A | 6/1981 | Schaus et al. | 126/110 R |
| 4,306,613 | A | 12/1981 | Christopher | 165/32 |

(List continued on next page.)

FOREIGN PATENT DOCUMENTS

| | | |
|---|---|---|
| EP | 0 065 995 | 8/1982 |
| JP | 01 269874 | 10/1989 |
| JP | WO 98/34076 | 8/1998 |

OTHER PUBLICATIONS

Lyn Bowman, A Technical Introduction to Free–Piston Stirling Cycle Machines: Engines, Coolers, and Heat Pumps, May, 1993, pp. 1–7.

B.D. Mennink et al., "Development of an Improved Stirling Cooler for Vacuum Super Insulated Fridges With Thermal Store and Photovoltaic Power Source for Industrialized and Developing Countries," May 10–13, 1994 pp. 1–9.

(List continued on next page.)

*Primary Examiner*—William C. Doerrler
*Assistant Examiner*—Malik N. Drake
(74) *Attorney, Agent, or Firm*—Sutherland Asbill & Brennan LLP

(57) ABSTRACT

A refrigeration apparatus driven by a Stirling cooler and having reduced internal vibrations. The apparatus may include an insulated enclosure. The enclosure may define an opening from the inside to the outside. A heat-conducting member may be disposed within the enclosure and in alignment with the opening. The apparatus may further include a Stirling cooler. The Stirling cooler may be selectively connectable to the heat-conducting member. A cushioning member may be disposed between the heat-conducting member and the enclosure, such that vibrations from the Stirling cooler to the enclosure are reduced.

52 Claims, 6 Drawing Sheets

U.S. PATENT DOCUMENTS 4,363,217 A * 12/1982 Venuti ..... 62/55.5
4,377,074 A 3/1983 Jardine ..... 62/183
4,383,421 A 5/1983 Quesnoit ..... 62/333
4,416,122 A 11/1983 Johnson ..... 62/448
4,471,633 A 9/1984 Tinsler ..... 62/295
4,480,445 A 11/1984 Goldstein ..... 62/434
4,490,991 A 1/1985 Schultz ..... 62/279
4,539,737 A 9/1985 Kerpers et al. ..... 29/423
4,554,797 A 11/1985 Goldstein ..... 62/434
4,558,570 A 12/1985 Shtrikman et al. ..... 62/6
4,694,650 A 9/1987 Vincent ..... 60/520
4,726,193 A 2/1988 Burke et al. ..... 62/3
4,759,190 A 7/1988 Trachtenberg et al. ..... 62/3
4,783,968 A 11/1988 Higham et al. ..... 62/6
4,811,563 A 3/1989 Furuishi et al. ..... 60/517
4,823,554 A 4/1989 Trachtenberg et al. ..... 62/3
4,827,733 A 5/1989 Dinh ..... 62/305
4,827,735 A 5/1989 Foley ..... 62/430
4,831,831 A 5/1989 Carter et al. ..... 62/59
4,843,826 A 7/1989 Malaker ..... 62/6
4,882,911 A 11/1989 Immel ..... 62/288
4,914,929 A * 4/1990 Shimazaki ..... 62/515
4,922,722 A 5/1990 Kazumoto et al. ..... 62/6
4,941,527 A 7/1990 Toth et al. ..... 165/47
4,949,554 A 8/1990 Branz et al. ..... 62/248
4,964,279 A 10/1990 Osborne ..... 62/59
4,977,754 A 12/1990 Upton et al. ..... 62/248
4,996,841 A 3/1991 Meijer et al. ..... 60/525
5,069,273 A 12/1991 O'Hearne ..... 165/12
5,076,351 A 12/1991 Munekawa et al. .... 165/104.21
5,094,083 A 3/1992 Horn et al. ..... 62/6
5,142,872 A 9/1992 Tipton ..... 62/6
5,228,299 A 7/1993 Harrington et al. ..... 62/55.5
5,259,198 A 11/1993 Viegas et al. ..... 62/7
5,259,214 A 11/1993 Nagatomo et al. ..... 62/324.1
5,284,022 A 2/1994 Chung ..... 62/6
5,303,769 A 4/1994 Hoegberg ..... 165/108
5,305,825 A 4/1994 Roehrich et al. ..... 165/64
5,309,986 A 5/1994 Itoh ..... 165/104.26
5,311,927 A 5/1994 Taylor et al. ..... 165/64
5,333,460 A 8/1994 Lewis et al. ..... 62/6
5,341,653 A 8/1994 Tippmann et al. ..... 62/288
5,347,827 A 9/1994 Rudick et al. ..... 62/440
5,402,654 A 4/1995 Rudick et al. ..... 62/448
5,406,805 A 4/1995 Radermacher et al. ..... 62/81
5,417,079 A 5/1995 Rudick et al. ..... 62/253
5,417,081 A 5/1995 Rudick et al. ..... 62/440
5,438,848 A 8/1995 Kim et al. ..... 62/342
5,440,894 A 8/1995 Schaeffer et al. ..... 62/203
5,493,874 A 2/1996 Landgrebe ..... 62/457.2
5,496,153 A 3/1996 Redlich ..... 417/212
5,524,453 A 6/1996 James ..... 62/434
5,525,845 A 6/1996 Beale et al. ..... 310/30
5,537,820 A 7/1996 Beale et al. ..... 60/517
5,542,257 A 8/1996 Mattern-Klosson et al. . 62/55.5
5,551,250 A 9/1996 Yingst et al. ..... 62/234
5,596,875 A 1/1997 Berry et al. ..... 62/6
5,638,684 A 6/1997 Siegel et al. ..... 62/6
5,642,622 A 7/1997 Berchowitz et al. ..... 62/6
5,645,407 A 7/1997 Kralick et al. ..... 417/383
5,647,217 A 7/1997 Penswick et al. ..... 62/6
5,647,225 A 7/1997 Fischer et al. ..... 62/434
5,649,431 A 7/1997 Schroeder, Jr. ..... 62/434
5,655,376 A 8/1997 Price ..... 62/6
5,678,409 A 10/1997 Price ..... 62/6
5,678,421 A 10/1997 Maynard et al. ..... 62/407
5,724,833 A 3/1998 Devers ..... 62/625
5,735,131 A 4/1998 Lambright, Jr. et al. ..... 62/99
5,782,106 A 7/1998 Park ..... 62/452
5,794,444 A 8/1998 Hofbauer et al. ..... 60/517
5,878,581 A 3/1999 DeFrances et al. ..... 62/50.2
5,881,566 A 3/1999 Shacklock et al. ..... 62/277
5,895,033 A 4/1999 Ross et al. ..... 267/161
5,906,290 A 5/1999 Haberkorn ..... 220/505
5,920,133 A 7/1999 Penswick et al. ..... 310/17
5,927,079 A 7/1999 Sekiya et al. ..... 62/6
5,927,080 A 7/1999 Lee ..... 62/6
6,003,319 A 12/1999 Gilley et al. ..... 62/3.7
6,023,937 A 2/2000 Rodrigues ..... 62/295
6,067,804 A 5/2000 Moeykens et al. ..... 62/84
6,073,547 A 6/2000 Westbrooks, Jr. et al. .... 99/468
6,079,481 A 6/2000 Lowenstein et al. ..... 165/10
6,112,526 A 9/2000 Chase ..... 62/6
6,148,634 A 11/2000 Sherwood ..... 62/434
6,158,499 A 12/2000 Rhodes ..... 165/10
6,178,770 B1 1/2001 Bradley, Jr. et al. ..... 62/434

OTHER PUBLICATIONS

D.M. Berchowitz et al., "Recent Advances in Stirling Cycle Refrigeration," Aug. 20–25, 1995, 8 pages.

Kelly McDonald et al., "Stirling Refrigerator for Space Shuttle Experiments," Aug. 7/11, 1994; 6 pages.

Sunpower, Inc., "Introduction to Sunpower, Stirling Machines and Free–Piston Technology," Dec., 1995.

D.M. Berchowitz et al., "Test Results for Stirling Cycle Cooled Domestic Refrigerators," Sep. 3–6, 1996, 9 pages.

Royal Vendors, Inc., "G–III All Purpose Vendor Operation and Service Manual,"Sep., 1996, pp. 1–67.

D.M. Berchowitz et al., "Stirling Coolers for Solar Refrigerators," 10 pages.

Michael K. Ewert et al., "Experimental Evaluation of a Solar PV Refrigerator with Thermoelectric, Stirling and Vapor Compression Heat Pumps," 7 pages.

D.M. Berchowitz, Ph.D., "Maximized Performance of Stirling Cycle Refrigerators," 8 pages.

David Bergeron, "Heat Pump Technology Recommendation for a Terrestrial Battery–Free Solar Refrigerator," Sep. 1998, pp. 1–25.

Seon–Young Kim, et al., "The Application of Stirling Cooler to Refrigeration," pp. 1023–1026.

R. H. Green, et al., "The Design and Testing of a Stirling Cycle Domestic Freezer," pp. 153–161.

Abstract of Japanese Publication No. 02302563 (Toshiba Corp.) Dec. 14, 1990.

Abstract of Japanese Publication No. 03036468 (Toshiba Corp.) Feb. 18, 1991.

Abstract of Japanese Publication No. 03294753 (Toshiba Corp.) Dec. 25, 1991.

Abstract of Japanese Publication No. 04217758 (Toshiba Corp.) Aug. 7, 1992.

Abstract of Japanese Publication No. 05203273 (Toshiba Corp.) Aug. 10, 1993.

Abstract of Japanese Publication No. 05306846 (Toshiba Corp.) Nov. 19, 1993.

Abstract of Japanese Publication No. 07180921 (Toshiba Corp.) Jul. 18, 1995.

Abstract of Japanese Publication No. 08005179 (Toshiba Corp.) Jan. 12, 1996.

Abstract of Japanese Publication No. 08100958 (Toshiba Corp.) Apr. 16, 1996.

Abstract of Japanese Publication No. 08247563 (Toshiba Corp.) Sep. 27, 1996.

* cited by examiner

APPARATUS USING STIRLING COOLER SYSTEM AND METHODS OF USE

RELATED APPLICATIONS

The present application is a continuation-in-part of application Ser. No. 09/412,687, filed Oct. 5, 1999, now allowed.

FIELD OF INVENTION

The present invention relates generally to refrigeration systems and, more specifically, to refrigeration systems that use a Stirling cooler as the mechanism for removing heat from a desired space. More particularly, the present invention relates to a glass door merchandiser for vending and for chilling beverage containers and the contents thereof.

BACKGROUND OF THE INVENTION

Known refrigeration systems generally have used conventional vapor compression Rankine cycle devices to chill a given space. In a typical Rankine cycle apparatus, the refrigerant in the vapor phase is compressed in a compressor so as to cause an increase in temperature. The hot, high-pressure refrigerant is circulated through a heat exchanger, called a condenser, where it is cooled by heat transfer to the surrounding environment. As a result, the refrigerant condenses from a gas back to a liquid. After leaving the condenser, the refrigerant passes through a throttling device where the pressure and the temperature are reduced. The cold refrigerant leaves the throttling device and enters a second heat exchanger, called an evaporator, located in or near the refrigerated space. Heat transfer with the evaporator and the refrigerated space causes the refrigerant to evaporate or to change from a saturated mixture of liquid and vapor into a superheated vapor. The vapor leaving the evaporator is then drawn back into the compressor so as to repeat the refrigeration cycle.

One alternative to the use of a Rankine cycle system is a Stirling cycle cooler. The Stirling cycle cooler is also a well-known heat transfer mechanism. Briefly described, a Stirling cycle cooler compresses and expands a gas (typically helium) to produce cooling. This gas shuttles back and forth through a regenerator bed to develop much greater temperature differentials than may be produced through the normal Rankine compression and expansion process. Specifically, a Stirling cooler may use a displacer to force the gas back and forth through the regenerator bed and a piston to compress and expand the gas. The regenerator bed may be a porous element with significant thermal inertia. During operation, the regenerator bed develops a temperature gradient. One end of the device thus becomes hot and the other end becomes cold. See David Bergeron, *Heat Pump Technology Recommendation for a Terrestrial Battery-Free Solar Refrigerator,* September 1998. Patents relating to Stirling coolers include U.S. Pat. Nos. 5,678,409; 5,647,217; 5,638,684; 5,596,875; and 4,922,722, all incorporated herein by reference.

Stirling cooler units are desirable because they are nonpolluting, efficient, and have very few moving parts. The use of Stirling coolers units has been proposed for conventional refrigerators. See U.S. Pat. No. 5,438,848, incorporated herein by reference. The integration of a free-piston Stirling cooler into a conventional refrigerated cabinet, however, requires different manufacturing, installation, and operational techniques than those used for conventional compressor systems. See D. M. Berchowitz et al., *Test Results for Stirling Cycle Cooler Domestic Refrigerators,* Second International Conference.

To date, the use of Stirling coolers in beverage vending machines, GDM's and dispensers is not known. Therefore, a need exists for adapting Stirling cooler technology to conventional beverage vending machines, GDM's, dispensers, and the like.

SUMMARY OF THE INVENTION

The present invention thus may provide a refrigeration apparatus driven by a Stirling cooler and having reduced internal vibrations. The apparatus may include an insulated enclosure. The enclosure may define an opening from the inside to the outside. A heat-conducting member may be disposed within the enclosure and in alignment with the opening. The apparatus may further include a Stirling cooler. The Stirling cooler may be selectively connectable to the heat-conducting member. A cushioning member may be disposed between the heat-conducting member and the enclosure, such that vibrations from the Stirling cooler to the enclosure are reduced.

Specific embodiments of the invention include the use of a Stirling cooler having a hot portion, a regenerator portion, and a cold portion. The cold portion may be in axial alignment with the hot portion and the regenerator portion. The regenerator portion may be disposed between the hot portion and the cold portion. The cold portion may include a larger diameter that the regenerator portion. The cold portion thus may include a flange that extends outward in a radial direction for a distance greater than the diameter of the regenerator portion.

The cushioning member may include an elastomeric member, a compliant foam, a low durometer polyurethane, a Sorbothane polymer, a rubber material, or similar types of materials. The cushioning member may be in the form of a toroidal element, a gasket, or similar shapes. The heat conducting member and the cold end of the Stirling cooler may be connected by a number of screws. The screws may use an elastomeric washer. The opening may include an indentation. The cushioning member may be positioned within the indentation.

A further embodiment of the present invention may provide an enclosure refrigerated by a refrigeration system having a Stirling cooler and a heat-conducting member. The enclosure may include a number of walls with one of the walls having an aperture therein. The refrigeration system may be positioned about the aperture. A cushion member may be positioned between the wall and the refrigeration system.

The cushioning member may include an elastomeric member, a low durometer polyurethane, a Sorbothane polymer, or similar materials. The cushioning member may be a toroidal element. The aperture may include an indentation positioned therein. The aperture may include a predetermined diameter. The predetermined diameter may permit the Stirling cooler to pass through and may or may not allow the heat-conducting member to pass through.

The one wall may be the bottom wall. The cushioning member may be positioned within the indentation. An insulated plug may be positioned between the Stirling cooler and the cushioning layer. The insulated plug and the cushioning element may form a seal therebetween.

The one wall also may be the top wall. An elastomeric ring may be positioned within the indentation. A sealing plate may be positioned within the indentation. The cushioning element may include a number of springs or other types of dampening devices positioned between the Stirling cooler and the sealing plate. A sealing ring may be positioned between the sealing plate and the Stirling cooler.

A further embodiment of the present invention may provide for an enclosure. The enclosure may include a number of walls defining an interior space. One of the walls may include an aperture therein. A Stirling cooler may be positioned within the aperture. A heat-conducting member may be attached to the Stirling cooler and positioned within the interior space. A cushioning member may be positioned between the wall and the heat-conducting member.

The wall may be the bottom wall. The cushioning member may include an elastomeric member, a Sorbothane polymer, or similar types of materials. The aperture may include an indentation positioned therein. The cushioning member may be positioned within the indentation. The aperture may include a predetermined diameter. The predetermined diameter may permit the Stirling cooler to pass through but prohibit the heat-conducting member from passing therethrough. An insulated plug may be positioned between the Stirling cooler and the cushioning layer. The insulated plug and the cushioning member may form a seal therebetween. An attachment ring may connect the Stirling cooler and the heat-conducting member.

A further embodiment of the present invention may provide for an enclosure. The enclosure may include a number of walls defining an interior space. One of the walls may include an aperture therein. A Stirling cooler may be positioned about the aperture. A heat-conducting member may be attached to the Stirling cooler and positioned within the interior space. A dampening device may be attached to the Stirling cooler and the one wall so as to absorb the vibrations produced by the Stirling cooler.

The wall may be the top wall. The dampening device may include a number of springs. The wall may include a sealing ring positioned within the aperture. The aperture may include an indentation positioned therein. An elastomeric ring may be positioned within the indentation. The aperture may have a predetermined diameter. The predetermined diameter permits the heat-conducting member to pass through. A sealing ring may be positioned between the sealing plate and the Stirling cooler.

These and other objects, features, and advantages of the present invention will become apparent after a review of the following detailed description of the disclosed embodiments and the appended drawing and claims.

DETAILED DESCRIPTION OF THE DISCLOSED EMBODIMENTS

The present invention utilizes one or more Stirling coolers. A particularly useful type of Stirling cooler is a free-piston Stirling cooler. A free piston Stirling cooler useful in the present invention is available from Global Cooling of Athens, Ohio. Other Stirling coolers useful in the present invention are shown in U.S. Pat. Nos. 5,678,409; 5,647,217; 5,638,684; 5,596,875; 5,438,848; and 4,922,722, the disclosures of which are all incorporated herein by reference. Any conventional type of free piston Stirling cooler, however, may be used herein.

Figure 1:
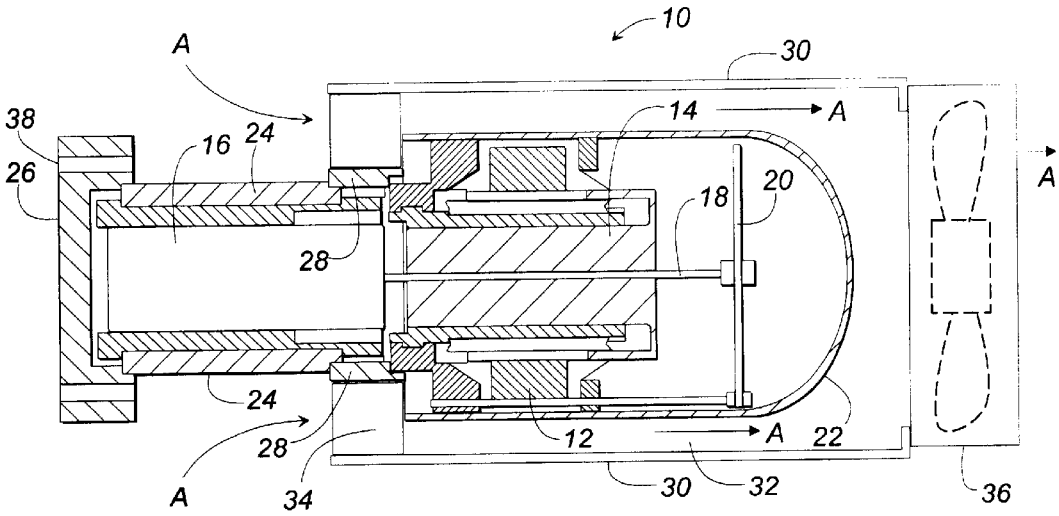
FIG. 1 is a cross-sectional view of a free-piston Stirling cooler useful in the present invention.
Figure 2:
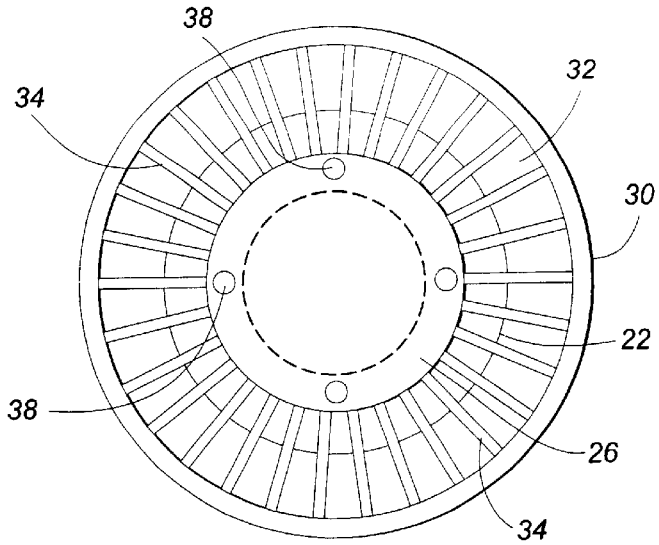
FIG. 2 is an end view of the Stirling cooler shown in FIG. 1.

With reference to the drawings, in which like numbers indicate like elements throughout the several views, FIG. 1 shows a free-piston Stirling cooler 10. The Stirling cooler 10 may have a linear electric motor 12, a free piston 14, a displacer 16, a displacer rod 18, a displacer spring 20, an inner casing 22, a regenerator 24, an acceptor or cold portion 26, and a rejector or hot portion 28. The function of these elements is well known in the art Stirling cooler refrigeration and, therefore, will not be explained further here.

The Stirling cooler 10 also may include a cylindrical outer casing 30 spaced from the inner casing 22 and defining an annular space 32 therebetween. The outer casing 30 may be attached to the hot portion 28 of the Stirling cooler 10 by a plurality of heat-conducting fins 34 that extend radially outwardly from the hot portion to the outer casing. The fins 34 may be made from a heat conducting material, such as aluminum or similar types of materials. Attached to the end of the outer casing 30 opposite the fins 34 may be an electric fan 36. The fan 36 may direct a flow of air into the Stirling cooler 10 through the end of the outer casing 30. The air flow may pass through the fins 34, along the space 32, and out of the opposite end of the outer casing 30 in the direction shown by the arrows at "A."

The cold portion 26 of the Stirling cooler 10 may be greater in diameter than the regenerator 24. A number of threaded holes 38 for receiving threaded bolts are provided in the cold portion 26. The threaded holes 38 provide a means for mounting the Stirling cooler 10 to apparatus as will be discussed further below.

Figure 3:
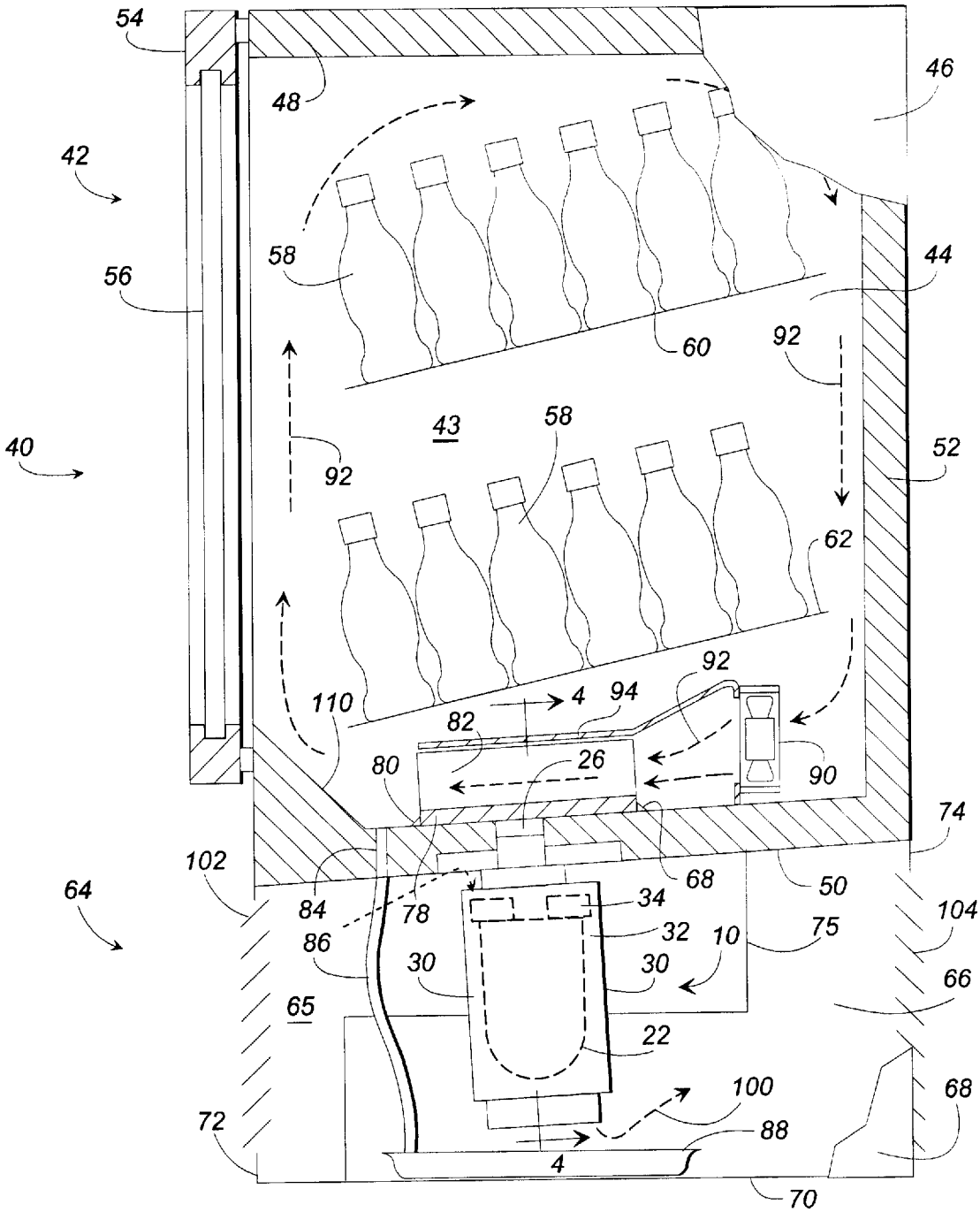
FIG. 3 is a side cross-sectional, schematic, partial broken away view of a disclosed embodiment of a glass door merchandiser in accordance with the present invention.

FIG. 3 shows a glass door merchandiser 40 ("GDM 40") for beverage containers and other objects. The upper portion 42 of the GDM 40 may include an insulated enclosure 43. The insulated enclosure 43 may have a number of insulated sidewalls 44, 46, a number of insulated top and bottom walls 48, 50, respectively, and an insulated back wall 52. The GDM 40 also may include a front door 54. The front door 54 may include a pane of glass 56 such that the contents of the GDM 40 may be viewed from the outside. The walls 44, 46, 48, 50, 52 and the door 54 define the insulated chamber or the enclosure 43. A number of wire shelves 60, 62 also may be mounted inside the enclosure 43. A number of beverage containers 58 or other products may be stored on the shelves 60, 62.

A lower portion 64 of the GDM 40 may include an uninsulated enclosure 65. The uninsulated enclosure 65 may include a number of sidewalls 66, 68, a bottom wall 70, and front and back walls 72, 74, respectively. The walls 66, 68,

70, 72, 74 define the uninsulated chamber or the enclosure 65 that functions as a base for the insulated enclosure 43 and as a mechanical enclosure for the Stirling cooler 10 and the associated parts and equipment. The lower portion 64 also may include a hot air shroud 75 so as to direct the flow of waste heat out of the GDM 40 as described in more detail below.

Disposed within part of the uninsulated enclosure 65 is the Stirling cooler 10. Although the present invention is illustrated as using a single Stirling cooler 10, it is specifically contemplated that more than one Stirling cooler 10 can be used. The number of Stirling coolers 10 used may depend upon the desired size and capacity of the GDM 40 as a whole. The uninsulated enclosure 65 also may be positioned in the upper portion of the GDM 40 or elsewhere therein.

Figure 4:
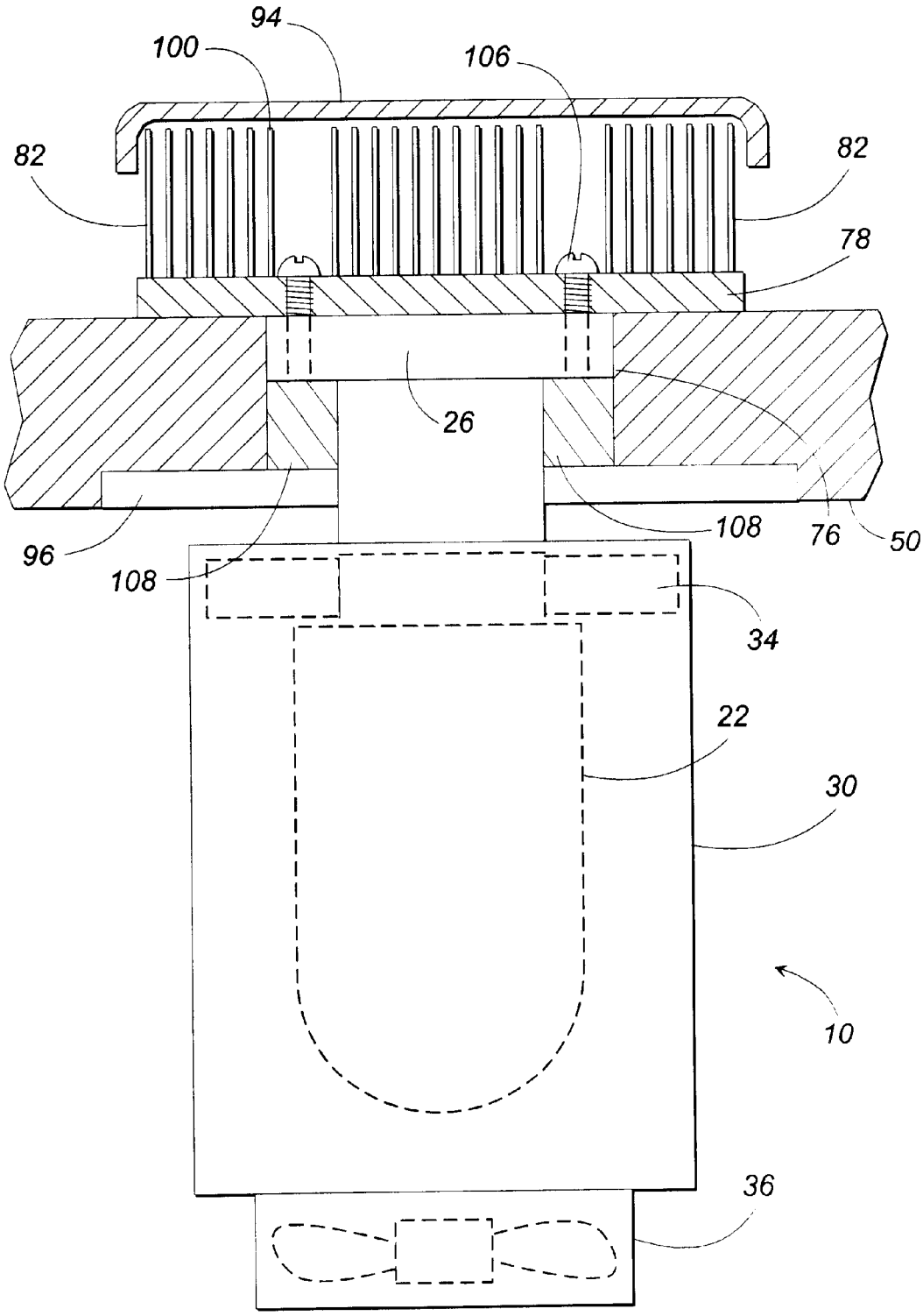
FIG. 4 is a partial cross-sectional view taken along the line 4—4 of the lower portion of the glass door merchandiser shown in FIG. 3.

As is shown in FIG. 4, the bottom wall 50 of the insulated enclosure 43 may define an aperture 76. The cold portion 26 of the Stirling cooler 10 may extend through the aperture 76. Disposed above the aperture 76 may be a rectangular plate 78. The rectangular plate 78 may be made from a heat-conducting material, such as aluminum or similar types of materials. The cold portion 26 of the Stirling cooler 10 may contact the heat-conducting plate 78 such that heat may flow from the plate 78 to the cold portion 26 of the Stirling cooler 10. A waterproof sealant, such as a bead of silicone 80 (FIG. 3) may be placed at the juncture of the plate 78 and the bottom wall 50, i.e., around the periphery of the plate 78. The silicone 80 may prevent fluids, such as condensed water vapor, from getting under the plate 78 and contacting the components of the Stirling cooler 10. The plate 78 may be attached to the bottom wall 50 by bolts (not shown) or by other types of joinder devices and methods.

A plurality of heat conducting fins 82 may be attached to the plate 78 and extend upwardly therefrom. The fins 82 may be substantially rectangular in shape. Alternatively, the fins 82 may have any conventional shape. The fins 82 may be made from a heat conducting material, such as aluminum, or from similar types of materials. As is shown in FIG. 4, the fins 82 may be equally spaced from and generally parallel to each other such that air can freely flow between the adjacent plates. The fins 82 may be attached to the plate 78 such that heat can flow from the fins 82 to the plate 78.

The bottom wall 50 may be disposed at an angle whereby the front of the bottom wall 50 is slightly lower than the rear of the bottom wall 50. This angle may allow fluids, such as water, that fall onto the bottom wall 50 to run down the bottom wall 50 under the influence of gravity. At its lowest point, the bottom wall 50 may define a drain passage 84 that extends from the inside of the insulated enclosure 43 to the outside of the insulated enclosure 43, i.e., to the inside of the uninsulated enclosure 65. The drain passage 84 may permit fluid, such as water, that runs down the bottom wall 50 to flow through the passage 84 so as to remove the water from the insulated enclosure 43.

A pipe or tube 86 may be attached to the drain passage 84 and extend downwardly therefrom. A fluid container, such as a pan 88, may be disposed on the bottom 70 of the uninsulated enclosure 65 below the drain passage 84. Fluid that flows down the drain passage 84 may be directed through the tube 86 and into the pan 88 where the fluid may be collected.

A fan 90 may be attached to the bottom wall 50 adjacent to the rear of the insulated enclosure 43. The fan 90 may be oriented such that it will blow air in the direction indicated by the arrows at 92. Attached to the fan 90 may be a shroud 94 that extends outwardly from the fan 90 toward and over the fins 82. The shroud 94 may assist in directing the air blown by the fan 90 through the fins 82.

As previously indicated, the Stirling cooler 10 may disposed in the uninsulated enclosure 65 below the bottom wall 50 of the insulated enclosure 43. The portion of the bottom wall 50 adjacent the Stirling cooler 10 may define a recessed portion 96. The recessed portion 96 provides more room for air to flow between the bottom wall 50 and the outer casing 30 of the Stirling cooler 10. This spacing may permit air to flow more freely into the annular space 32, through the fins 34, and out the fan 36.

As indicated by the arrow at 100, the fan 36 may be oriented such that it blows air toward the pan 88. The air flowing between the fins 34 of the Stirling cooler 10 may be heated by the heat transferred from the hot portion 28 of the Stirling cooler 10 to the fins 34 and hence to the air surrounding the fins 34. This warmed air is then blown by the fan 36 toward the pan 88. The warm air blowing from the fan 36 thus promotes evaporation of the fluid in the pan 88. The hot air shroud 75 maintains the air flow within the uninsulated enclosure 43. Louvers 102, 104 may be provided in the front and rear walls 72, 74, respectively, so as to permit air to flow freely through the uninsulated enclosure 65.

The Stirling cooler 10 may be attached to the GDM 40 by four threaded bolts 106 that extend through holes in the plate 78 aligned with the four threaded holes 38 in the cold portion 26 of the Stirling cooler 10. The bolts 106 may be screwed into the holes 38 so as to attach the Stirling cooler 10 to the GDM 40. A toroidal piece of compliant foam insulation 108 may be press fit into the annular space between the cylindrical aperture 76 in the bottom wall 50 and the cylindrical shaft of the regenerator 24. The insulation 108 may prevent or at least reduce the amount of heat that is transferred to the cold portion 26 of the Stirling cooler 10 from the uninsulated enclosure 65. The insulation 108 also may limit the vibrations transferred from the Stirling cooler 10 to the GDM 40. Similar types of materials may be used in addition to the compliant foam insulation 108.

Operation of the GDM 40 will now be considered. The door 54 of the GDM 40 may be opened and a number of the beverage containers 58 may be stacked on the shelves 60, 62. The shelves 60, 62 are preferably slanted such that gravity moves the next beverage container 58 to a location adjacent the door 54 when a container is removed from the shelf 60, 62. Of course, level shelves 60, 62 also can be used in the present invention.

The fans 36, 90 and the Stirling cooler 10 are all operated by suitable electrical circuits (not shown). The fan 90 blows air across the fins 82 and generally circulates the air in the insulated enclosure 43 in the direction shown by the arrows at 92. The bottom wall 50 may include a wedge-shaped deflector portion 110 adjacent to the door 54 to assist in deflecting the air from the fan 90 upwardly in front of the door 54. Heat from the beverage containers 58 and the contents thereof may be transferred to the moving air circulating within the insulated enclosure 43. When the fan 90 blows the air in the insulated enclosure 43 across the fins 82, heat may be transferred from the air to the fins 82. Heat in the fins 82 may then be transferred to the plate 78 and hence to the cold portion 26 of the Stirling cooler 10. Operation of the Stirling cooler 10 then transfers the heat from the cold portion 26 to the hot portion 28. The heat may then be transferred to the fins 34 contained within the outer casing 30 of the Stirling cooler 10 and hence to the air surrounding the fins 34.

The cold airflow may result in condensation of the water vapor in the air onto the cold surface of the fins 82. When sufficient condensation forms on the fins 82, the condensation may run down the fins 82 onto the plate 78. Because the plate 78 is at an angle, the condensation may run off of the plate 78 onto the bottom wall 50. Because the bottom wall 50 is also at an angle, the condensation generally will seek the lowest point of the wall 50. Because the drain passage 84 is located at or near the lowest point of the bottom wall 50, the condensation will flow out of the insulated enclosure through the drain passage 84. Other condensation that may form on the inside walls of the insulated enclosure 43, on the beverage containers 58, on the wire racks 60, 62, or on the shroud 94, similarly will run onto the bottom wall 50 and hence through the drain passage 84.

The condensation may flow through the drain passage 84 into the tube 86. The tube 86 directs the fluid into the pan 88. The fluid from the tube 86 may collect within the pan 88. Fresh air may enter through the louvers 102. The air then may be warmed by the hot portion 28 and the fins 34 of the Stirling cooler 10. The air then may then be blown by the fan 36 through the space 32 between the inner casing 22 and outer casing 30 toward the fluid. This airflow may promote evaporation of the fluid from the pan 88. The moisture laden air created by the evaporation of the water in the pan 88 may then pass through the louvers 104 in the back walls 72, 74 of the uninsulated enclosure 65 and into the surroundings of the GDM 40.

Figure 5:
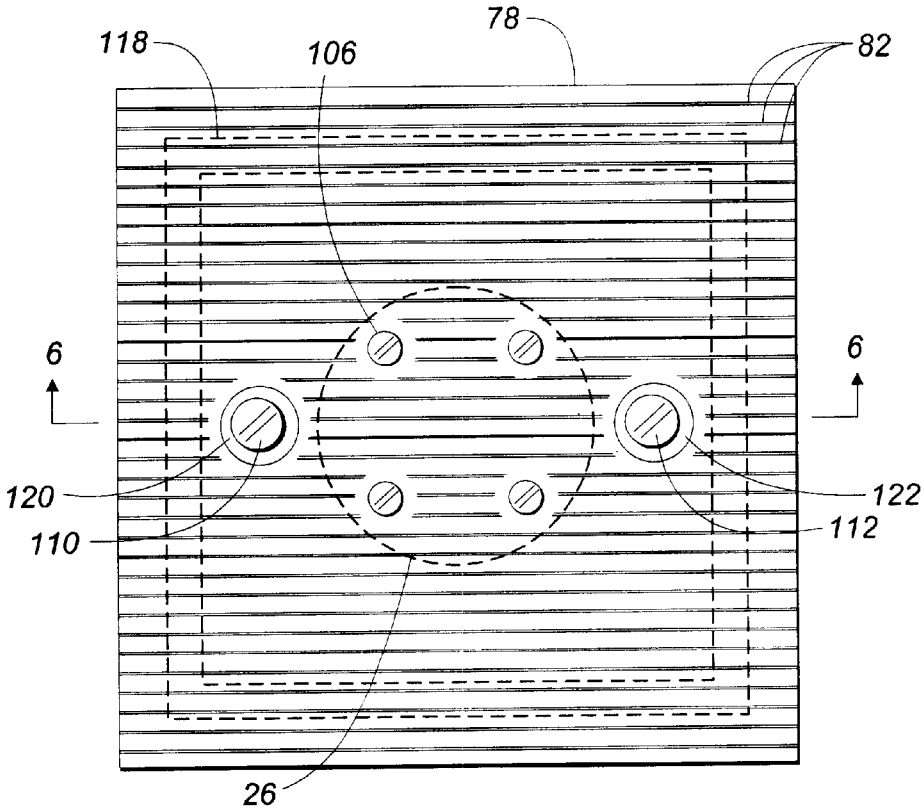
FIG. 5 is a top view of another disclosed embodiment of the heat exchange assembly mounted within the glass door merchandiser shown in FIG. 3, shown with the shroud removed for clarity.
Figure 6:
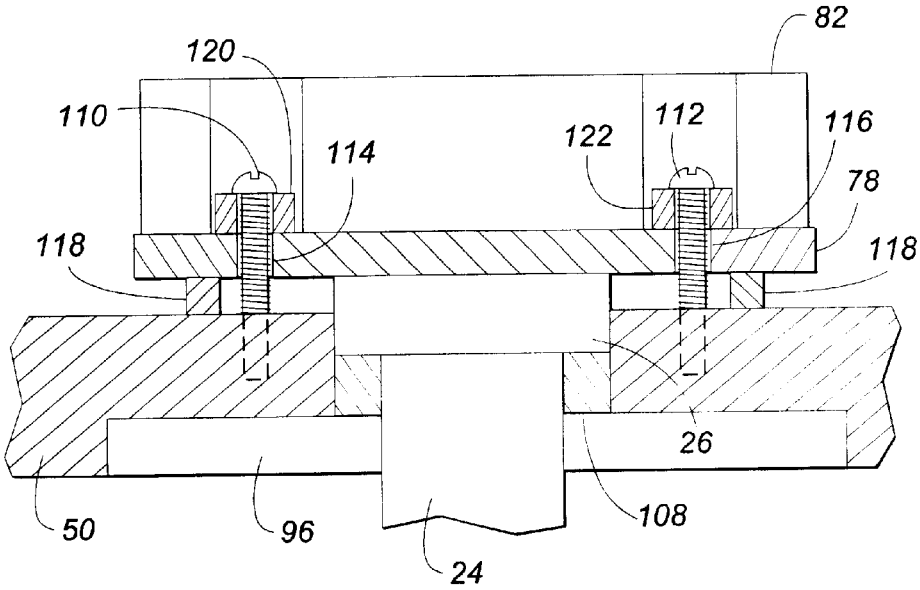
FIG. 6 is a cross-sectional view taken along the line 6—6 of the heat exchange assembly shown in FIG. 5, shown with the shroud removed for clarity.

FIGS. 5 and 6 show an alternate disclosed embodiment of the heat exchanger mounted within the GDM 40. As can best be seen in FIG. 6, the heat exchanger base plate 78 may include a number of fins 82 attached thereto. The fins 82 are discontinuous in the region of the screws 110, 112 and the four screws 106. The screws 110, 112 may extend through the holes 114, 116, through the plate 78, and attach the plate 78 to the bottom wall 50 of the GDM 40. A rectangular gasket 118 may be provided between the plate 78 and the bottom wall 50 of the GDM 40. The gasket 118 may be made from a compliant elastomeric material, such as low durometer polyurethane, or similar materials. The gasket 118 also may serve as a seal between the plate 78 and the bottom wall 50 of the GDM 40 so to eliminate the bead of silicone 80 as described above. In addition to the gasket 118, a closed cell foam, or similar materials also may be used.

One or more compliant elastomeric toroidal-shaped washers 120, 122 also may be provided for each of the screws 110, 112. The washers 120, 122 also may be made out of rubber, polyurethane, or similar types of materials. The washers 120, 122 may fit between the bottom of the head of each screw and the top surface of the plate 78. The gasket 118 and the washers 120, 122 may provide insulation in between the plate 78 and the bottom wall 50 of the GDM 40. The gasket 118 and the washers 120, 122 also may reduce the amount of vibration that is transferred from the Stirling cooler 10 to the plate 78 and then to the bottom wall 50. This reduced amount of vibration provides significantly quieter operation of the Stirling cooler 10.

When it is desired to remove the Stirling cooler 10 from the GDM 40 for repair or for maintenance, the four screws 106 may be removed. Removal of the screws 106 permits the Stirling cooler 10 to slide out of the aperture 76 in the bottom wall 50 and to be removed completely from the GDM 40. Repairs may then be made to the Stirling cooler 10 or a replacement Stirling cooler 10 may be reinstalled in the GDM 40 by sliding the cold portion 26 back into the aperture 76 and reinstalling the screws 106. The Stirling cooler 10 that was removed can then be repaired at a remote location.

Figure 7:
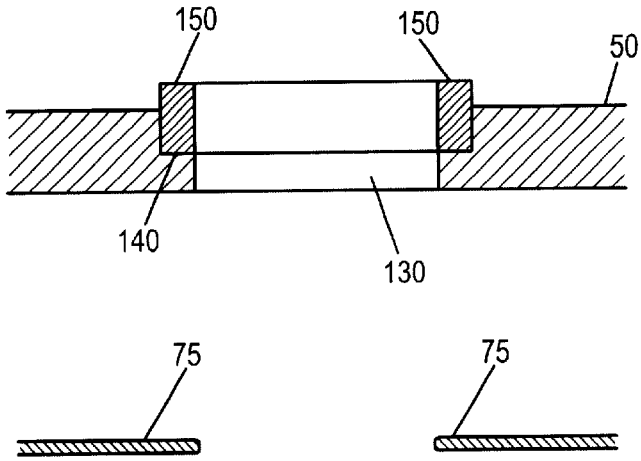
FIG. 7 is a side cross-sectional view of the bottom wall of an alternative embodiment of the glass door merchandiser.
Figure 8:
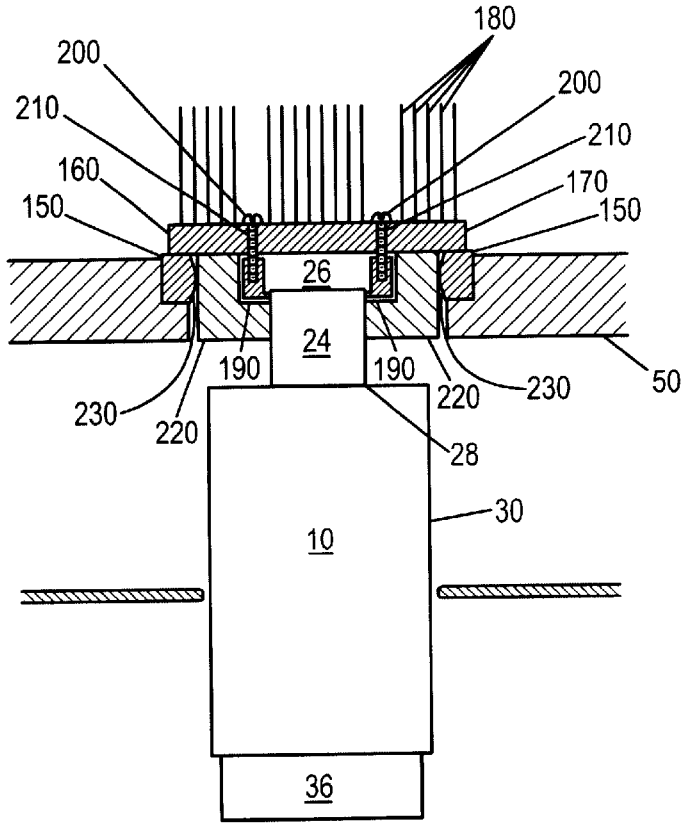
FIG. 8 is a side cross-sectional view of the Stirling cooler mounted within the bottom wall of the alternative embodiment of FIG. 7.

FIGS. 7 and 8 show an alternative means of mounting the Stirling cooler 10 to the bottom wall 50 of the GDM 40. In this case, the bottom wall 50 may have an aperture 130 therein. The aperture 130 may be somewhat larger than the aperture 76 described above so as to permit the passage therethrough of the components described below. Specifically, the outer casing 30 of the Stirling cooler 10 may pass through the aperture 130. The aperture 130 may have a diameter of about five (5) to about six (6) inches.

The aperture 130 also may have an indentation 140 on the upper half of the bottom wall 50. The indentation 140 may have a diameter somewhat greater than the diameter of the remainder of the aperture 130. The indentation 140 may have a diameter of about 5.5 to about 6.5 inches. Positioned within the indentation 140 may be an elastomeric ring 150. The elastomeric ring 150 may be a ring of a soft compliant elastomeric material such as Sorbothane, a rubber material such as neoprene rubber, or similar types of materials. By way of example, Sorbothane is a highly damped, viscoelastic material useful over a wide range of temperatures and frequencies. Sorbothane is a proprietary polymer available from Sorbothane, Inc. of Kent, Ohio.

The cold end 26 of the Stirling cooler 10 may be attached to a finned heat sink 160. The finned heat sink 160 may have a heat conducting plate 170 and a number of heat conducting fins 180. The heat conducting fins 180 may be substantially rectangular in shape. Alternatively, the heat conducting fins 180 may have any conventional shape. The heat conducting plate 170 and the heat conducting fins 180 may be made out of aluminum or other materials with good heat conducting characteristics. The heat conducting plate 170 and the heat conducting fins 180 may be similar to the rectangular plate 78 and the heat conducting fins 82 described above.

The cold end 26 of the Stirling cooler 10 may be attached to the heat conducting plate 170 via an attachment ring 190 and a number of screws 200. The attachment ring 190 may be substantially "L" or "U" shaped in cross section such that the attachment ring 190 supports the bottom of the cold end 26 of the Stirling cooler 10 in cup-like fashion. The attachment ring 190 may be made out of aluminum, engineering thermoplastics, or similar types of materials. The screws 200 may extend through a number of apertures 210 in the heat conducting plate 170 and extend into the attachment ring 190. Other types of conventional attachment means may be used.

The attachment ring 190, the cold end 26 of the Stirling cooler 10, and part of the regenerator 24 of the Stirling cooler 10 may be surrounded in part by an insulated plug 220. The insulated plug 220 may be made out of a polyurethane foam, an expanded polystyrene foam, or similar materials and may be substantially toroidal in shape. The insulated plug 220 insulates the cold end 26 of the Stirling cooler 10 and the heat conducting plate 170 from the hot end 28 of the Stirling cooler 10 and the ambient air on the other side of the bottom wall 50.

The Stirling cooler 10, with the finned heat sink 160 attached thereto, may be lowered through the aperture 130 in the bottom wall 50. The weight of the Stirling cooler 10 and the finned heat sink 160 may cause the elastomeric ring 150 to compress against or towards the plug 220. In this position, the elastomeric ring 150 supports the weight of the Stirling cooler 10 and the finned heat sink 160. The elastomeric ring 150 also vibrationally isolates the Stirling cooler 10 from the bottom wall 50 and the GDM 40 as a whole in a substantial manner given its dampening qualities.

If the elastomeric ring 150 bulges inward far enough to contact the outer diameter of the insulated plug 220, a secondary seal 230 may be formed. The secondary seal 230 also may prevent ambient air from reaching the other side of the finned heat sink 160. The secondary seal 230 further may prevent condensation from forming underneath the heat sink 160. When the Stirling cooler 10 and the finned heat sink 160 are removed from the aperture 130, the elastomeric ring 150 may return to its original shape. By doing so, the elastomeric ring 150 may provide sufficient clearance to remove the refrigeration components therethrough.

Figure 9:
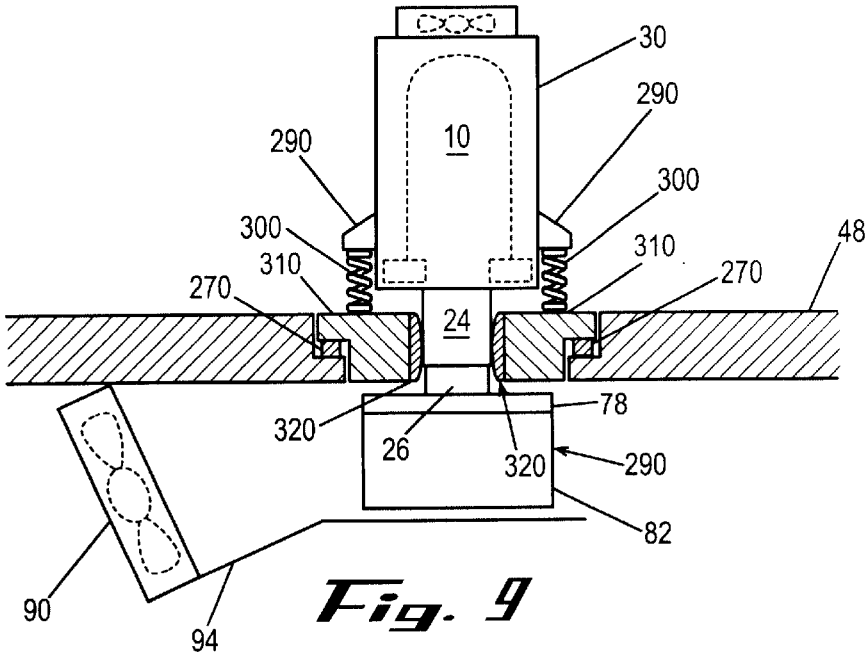
FIG. 9 is a side cross-sectional view of the top wall of an alternative embodiment of the glass door merchandiser with the Stirling cooler positioned therein.
Figure 10:
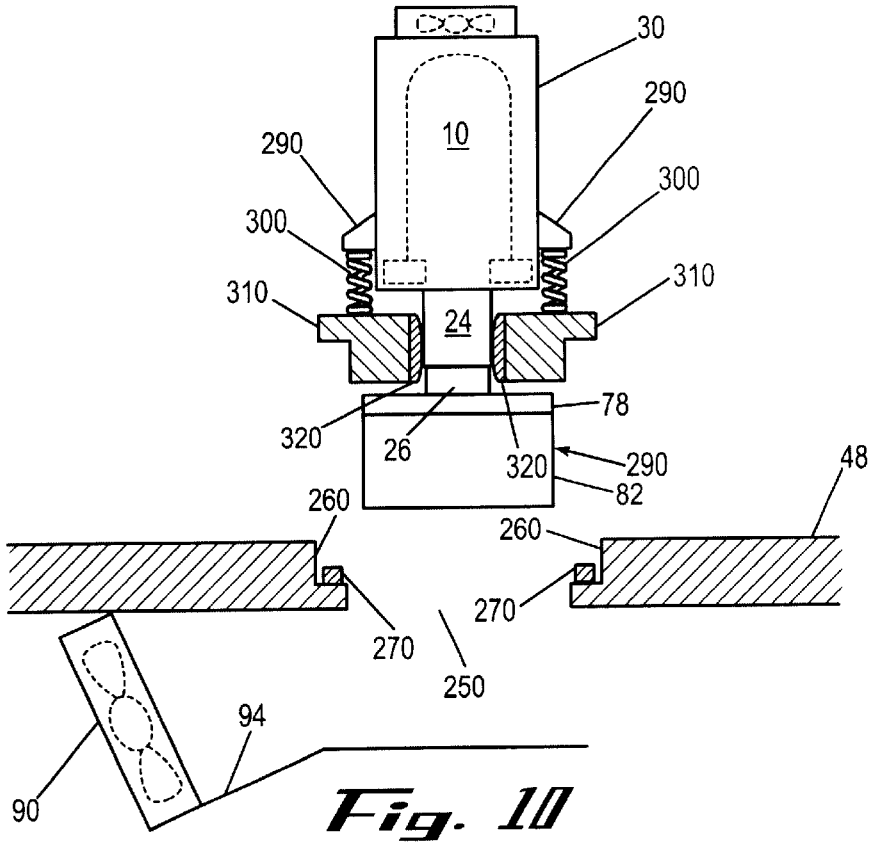
FIG. 10 is a side cross-sectional view of the Stirling cooler being removed from the top wall of the alternative embodiment of FIG. 9.

FIGS. 9 and 10 show a further embodiment of the present invention, a top-mounted Stirling cooler 10. In this embodiment, the Stirling cooler 10 may be inserted within the top wall 48 of the GDM 40. The fan 90 also may be attached to the top wall 48. Likewise, the shroud 94 may be positioned adjacent to the fan 90 and the refrigeration components as described below so as to circulate air therethrough.

The top wall 48 may have an aperture 250 positioned therein. The aperture 250 may be similar to the aperture 130 described above and may have a diameter of about seven (7) to about eight (8) inches. The aperture 250 may have an indentation 260 therein of a greater diameter than the remainder of the aperture 250. The indentation 260 may have a diameter of about 7.5 to about 8.5 inches. Positioned within the indentation 260 may be an elastomeric ring 270. The elastomeric ring 270 may be made out of any compliant material, such as an elastomeric foam, or similar types of materials. The elastomeric ring 270 may be similar to the elastomeric ring 150 described above.

Attached to the cold end 26 of the Stirling cooler 10 may be a finned heat sink 290. The finned heat sink 290 may include the heat conducting plate 78 and the heat conducting fins 82 as described above. The finned heat sink 290 may be attached to the cold end 26 of the Stirling cooler 10 by bolts, screws, or other types of conventional means.

Attached to the outer casing 30 of the Stirling cooler 10 may be a number of attachment brackets 290. The attachment brackets 290 may be attached to the outer casing 30 by bolts, screws, or by other types of conventional joinder devices. One or more springs 300 may be attached to the attachment bracket 290. The springs 300 may be any type of conventional spring and also may include elastomeric springs, leaf springs, or similar types of vibration dampening devices.

Attached to the other end of the springs 300 may be a sealing plate 310. The sealing plate 310 may be toroidal in shape and be made out of a polyurethane foam, an expanded polystrene, or other types of materials with good insulating characteristics. The sealing plate 310 may substantially fill the aperture 250 of the top wall 48. The sealing plate 310 may rest upon the elastromeric ring 270 and form a seal therewith. A sealing ring 320 may be positioned within the inner diameter of the sealing plate 310. The sealing ring 320 may be a ring of a compliant material that is positioned between the regenerator 24 and the inner diameter of the sealing plate 310. The sealing ring 320 may be made out of an elastomeric foam, an injection molded elastomer, or similar types of materials. The sealing ring 320 may move freely up and down the length of the regenerator 24 so as to allow the Stirling cooler 10 to vibrate on the sealing plate 310 via the springs 300 while maintaining at least a partial seal therewith.

In use, the Stirling cooler 10, with the finned heat sink 280 attached thereto, may be lowered into the aperture 250. The sealing plate 310 rests upon the elastomeric ring 270 positioned within the indentation 260. Once in place, the springs 300 allow the Stirling cooler 10 to move up and down on the sealing plate 310. Likewise, the sealing ring 320 may freely move up and down along the length of the regenerator 24 while maintaining at least a partial seal therebetween. The Stirling cooler 10 thus can vibrate on the springs 300 without transmitting significant amounts of vibration to the sealing plate 310 and hence the upper wall 48 of the GDM 40. Further, the sealing ring 320 largely prevents ambient air from leaking into the insulated enclosure 43 without interfering with the up and down vibratory motion of the Stirling cooler 10.

Once the Stirling cooler 10 is in place, the shroud 94 may direct a flow of air from the fan 90 through the finned heat sink 280 so as to cool the insulated enclosure 43 of the GDM 40. Likewise, the Stirling cooler 10 also may be lifted out of the aperture 250 and replaced.

It should be understood, of course, that the foregoing relates only to certain disclosed embodiments of the present invention and that numerous modifications or alterations may be made herein without departing from the spirit and scope of the invention as set forth in the appended claims.

I claim:

1. An apparatus comprising:

an insulated enclosure, said enclosure having an outside and an inside;

said enclosure defining an opening from said inside to said outside;

a heat-conducting member disposed within said enclosure and in alignment with said opening;

a Stirling cooler having a hot portion and a cold portion;

said cold portion being selectively connectable to said heat-conducting member; and a cushioning member disposed between said heat-conducting member and said enclosure, such that the transmission of vibration from said Stirling cooler to said enclosure is reduced.

2. The apparatus of claim 1, wherein said Stirling cooler comprises:

a hot portion;

a regenerator portion;

a cold portion in axial alignment with said hot portion and said regenerator portion;

said regenerator portion being disposed between said hot portion and said cold portion;

said cold portion comprising a larger diameter than said regenerator portion such that said cold portion comprises a flange that extends radially outwardly a distance greater than a diameter of said regenerator portion.

3. The apparatus of claim 1, wherein said cushioning member comprises an elastomeric member.

4. The apparatus of claim 1, wherein said cushioning member comprises a compliant foam.

5. The apparatus of claim 1, wherein said cushioning member comprises a low durometer polyurethane.

6. The apparatus of claim 1, wherein said cushioning member comprises a Sorbothane polymer.

7. The apparatus of claim 1, wherein said cushioning member comprises a toroidal element.

8. The apparatus of claim 1, further comprising a plurality of screws, said plurality of screws connecting said heat-conducting member and said Stirling cooler.

9. The apparatus of claim 8, further comprising a plurality of elastomeric washers positioned about said plurality of screws.

10. The apparatus of claim 1, wherein said opening comprises an indentation and wherein said cushioning member is positioned within said indentation.

11. The apparatus of claim 1, wherein said cushioning member comprises a gasket.

12. The enclosure of claim 1, wherein said cushioning member comprises a rubber material.

13. An enclosure refrigerated by a refrigeration system having a Stirling cooler and a heat conducting member, said enclosure comprising:

a plurality of walls;

one of said plurality of walls comprising an aperture therein;

said refrigeration system positioned about said aperture; and a cushion member positioned between said one wall and said refrigeration system.

14. The enclosure of claim 13, wherein said cushioning member comprises an elastomeric member.

15. The enclosure of claim 13, wherein said cushioning member comprises a low durometer polyurethane.

16. The enclosure of claim 13, wherein said cushioning member comprises a Sorbothane polymer.

17. The enclosure of claim 13, wherein said cushioning member comprises a toroidal element.

18. The enclosure of claim 13, wherein said aperture comprises an indentation positioned therein.

19. The enclosure of claim 17, wherein said aperture comprises a predetermined diameter.

20. The enclosure of claim 19, wherein said predetermined diameter permits said Stirling cooler to pass through.

21. The enclosure of claim 19, wherein said predetermined diameter permits said Stirling cooler and said heat conducting member to pass through.

22. The enclosure of claim 18, wherein said one wall comprises a bottom wall.

23. The enclosure of claim 22, wherein said cushioning member is positioned within said indentation.

24. The enclosure of claim 22, further comprising an insulated plug positioned between said Stirling cooler and said cushioning layer.

25. The enclosure of claim 24, wherein said insulated plug and said cushioning element comprise a seal therebetween.

26. The enclosure of claim 18, wherein said one wall comprises a top wall.

27. The enclosure of claim 26, further comprising an elastomeric ring positioned within said indentation.

28. The enclosure of claim 26, further comprising a sealing plate positioned within said indentation.

29. The enclosure of claim 28, wherein said cushioning element comprises a plurality of springs positioned between said Stirling cooler and said sealing plate.

30. The enclosure of claim 28, further comprising a sealing ring positioned between said sealing plate and said Stirling cooler.

31. A enclosure, comprising:

a plurality of walls defining an interior space;

one of said plurality of walls comprising an aperture therein;

a Stirling cooler positioned within said aperture;

a heat conducting member attached to said Stirling cooler and positioned within said interior space; and a cushioning member positioned between said one wall and said heat-conducting member.

32. The enclosure of claim 31, wherein said cushioning member comprises an elastomeric member.

33. The enclosure of claim 31, wherein said cushioning member comprises a Sorbothane polymer.

34. The enclosure of claim 31, wherein said aperture comprises an indentation positioned therein.

35. The enclosure of claim 34, wherein said cushioning member is positioned within said indentation.

36. The enclosure of claim 31, wherein said one wall comprises a bottom wall.

37. The enclosure of claim 31, wherein said aperture comprises a predetermined diameter.

38. The enclosure of claim 37, wherein said predetermined diameter permits said Stirling cooler to pass through.

39. The enclosure of claim 37, wherein said predetermined diameter prohibits said heat-conducting member from passing therethrough.

40. The enclosure of claim 31, further comprising an insulated plug positioned between said Stirling cooler and said cushioning layer.

41. The enclosure of claim 40, wherein said insulated plug and said cushioning member comprise a seal therebetween.

42. The enclosure of claim 31, further comprising an attachment ring connecting said Stirling cooler and said heat-conducting member.

43. The enclosure of claim 30, wherein said cushioning member comprises a rubber material.

44. A enclosure, comprising:

a plurality of walls defining an interior space;

one of said plurality of walls comprising an aperture therein;

a Stirling cooler positioned about said aperture;

a heat conducting member attached to said Stirling cooler and positioned within said interior space; and a dampening device attached to said Stirling cooler and said one wall so as to absorb the vibrations produced by said Stirling cooler.

45. The enclosure of claim 44, wherein said dampening device comprises a plurality of springs.

46. The enclosure of claim 44, wherein said one wall comprises a sealing ring positioned within said aperture.

47. The enclosure of claim 44, wherein said aperture comprises an indentation positioned therein.

48. The enclosure of claim 47, further comprising an elastomeric ring positioned within said indentation.

49. The enclosure of claim 44, wherein said one wall comprises a top wall.

50. The enclosure of claim 44, wherein said aperture comprises a predetermined diameter.

51. The enclosure of claim 50, wherein said predetermined diameter permits said heat-conducting member to pass through.

52. The enclosure of claim 44, further comprising a sealing ring positioned between said sealing plate and said Stirling cooler.

* * * * *